US007654502B2

(12) United States Patent
Embrey et al.

(10) Patent No.: US 7,654,502 B2
(45) **Date of Patent: *Feb. 2, 2010**

(54) APPARATUS FOR SIMULATED STONE PRODUCTS

(75) Inventors: Robert E. Embrey, Newark, OH (US); Douglas H. Walden, Newark, OH (US)

(73) Assignee: Owens Corning Intellectual Capital, LLCDE (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/824,906

(22) Filed: Jul. 3, 2007

(65) Prior Publication Data

US 2008/0001323 A1 Jan. 3, 2008

Related U.S. Application Data

(63) Continuation-in-part of application No. 11/323,618, filed on Dec. 30, 2005.

(51) Int. Cl.
*B22C 9/08* (2006.01)
*B22D 41/08* (2006.01)
*B28B 1/50* (2006.01)

(52) U.S. Cl. ..... 249/108; 249/110; 425/447

(58) Field of Classification Search ..... 249/105, 249/108, 110, 117, 119, 121; 425/64, 126.1, 425/588, 121, 589

See application file for complete search history.

(56) References Cited

U.S. PATENT DOCUMENTS 1,920,463 A 8/1933 Edwards
2,382,458 A 8/1945 Williams et al.
2,896,266 A * 7/1959 Anthony ..... 264/269
3,348,501 A * 10/1967 Stevens et al. ..... 105/248
3,694,533 A * 9/1972 Kelsey ..... 264/511
4,098,562 A 7/1978 Levin
4,964,795 A 10/1990 Tooman
5,308,572 A 5/1994 Hackman
5,597,591 A 1/1997 Hagenah
5,788,996 A 8/1998 Brouard
6,355,193 B1 3/2002 Stott
6,607,683 B1 8/2003 Harrington

* cited by examiner

*Primary Examiner*—Khanh Nguyen
*Assistant Examiner*—Vishal I Patel
(74) *Attorney, Agent, or Firm*—James J. Dottavio; Joan N. Drew

(57) ABSTRACT

An apparatus for manufacturing simulated stone products is provided. The apparatus includes a mold having mold cavities. The mold cavities have a first section and a second section that intersect to form a cavity angle. A hopper is configured to introduce castable material into the mold. The hopper and the mold are moveable with respect to each other, enabling them to be selectively engaged with each other. The hopper includes a first funnel wall configured to contact the top of the first mold cavity and to introduce castable material into the top opening of the first section. The hopper has a second funnel wall configured to contact the second section and act as a barrier to close the top opening of the second section of the mold cavity.

8 Claims, 8 Drawing Sheets

APPARATUS FOR SIMULATED STONE PRODUCTS

RELATED APPLICATIONS

This application is a continuation-in-part of copending application Ser. No. 11/323,618, filed Dec. 30, 2005, which is incorporated herein by reference in its entirety.

TECHNICAL FIELD

This invention relates to simulated stone products. More particularly this invention relates to molds and hoppers for manufacturing simulated stone products.

BACKGROUND OF THE INVENTION

Simulated stone products include simulated stone veneers and simulated stone architectural trim products. Simulated stone veneers are used as a lightweight veneer facing on masonry, and on metal framed or wood framed construction for architectural aesthetics. The products can be used for exterior applications such as building walls or interior applications such as fireplaces. Simulated stone architectural trim products include capstones, hearthstones, keystones, trim stones and the like. The simulated stone products are usually lower in cost than the natural stones that they replace.

CULTURED STONE® products are simulated stone products manufactured by Owens Corning. The CULTURED STONE® product line includes hundreds of designs of precast stone veneers and architectural trim products that replicate an extensive variety of textures, sizes, shapes and colors of natural stone. The products are manufactured using molds taken from natural stones. The molds generally include a mold cavity filled with a castable material. After the castable material has cured, or set, the simulated stone products are removed from the mold.

It is especially desired to have many types and shades of simulated stone products. It would be advantageous if simulated stone products could be manufactured more efficiently.

SUMMARY OF THE INVENTION

The above objects as well as other objects not specifically enumerated are achieved by an apparatus for manufacturing simulated stone products. The apparatus comprises a mold having one or more mold cavities. The mold cavities have a first section and a second section. The first and second sections have a longitudinal axis. The longitudinal axis of the first section intersects with the longitudinal axis of the second section to form a cavity angle. The first and second sections have top openings. The first and second sections are positioned such that castable material introduced into the top opening of the first section flows by gravity into the second section. At least one cover member is removably connected to the top opening of the second section of the mold cavity. The at least one cover member is configured to contain the castable material within the second section of the mold cavity as the castable material flows into the second section of the mold cavity. The at least one cover member is removable to allow the simulated stone product to be removed from the mold cavity after hardening. A mechanism is provided to introduce castable material into the top opening of the first section of the mold cavity.

According to this invention there is also provided an apparatus for manufacturing simulated stone products. The apparatus comprising a mold having one or more mold cavities.

The mold cavities have a first section and a second section. The first and second sections have longitudinal axis. The longitudinal axis of the first section intersects with the longitudinal axis of the second section to form a cavity angle. The first and second sections have top openings. The first and second sections of the mold are positioned such that castable material introduced into the top opening of the first section flows by gravity into the second section. A mechanism is configured to introduce castable material into the top opening of the first section of the mold cavity. The mechanism is positioned to contact the mold as the castable material flows from the first section of the mold cavity into the second section of the mold cavity. The mechanism includes a cover member configured to contact the top opening of the second section of the mold cavities and contain the castable material within the second section of the mold cavity as the castable material flows into the second section of the mold cavities. The mechanism is removable from the mold allowing the simulated stone product to be removed from the mold cavity after hardening.

According to this invention there is also provided a method for manufacturing simulated stone products. The method comprises providing a mold having one or more mold cavities, the mold cavities having a first section and a second section, the first and second sections having a longitudinal axis, the longitudinal axis of the first section intersecting with the longitudinal axis of the second section to form a cavity angle, the first and second sections having top openings, positioning first and second sections such that castable material introduced into the top opening of the first section can flow by gravity into the second section, removably connecting at least one cover member to the top opening of the second section of the mold cavity, the at least one cover member being configured to contain the castable material within the second section of the mold cavity as the castable material flows into the second section of the mold cavity, the at least one cover member being removable to allow the simulated stone product to be removed from the mold cavity after hardening, introducing castable material into the top opening of the first section of the mold cavities, the castable material flowing by gravity from the first section of the mold cavity to the second section of the mold cavity, allowing the castable material to harden to form simulated stone products, removing the at least one cover member; and removing the simulated stone product from the mold cavity.

Various objects and advantages of this invention will become apparent to those skilled in the art from the following detailed description of the preferred embodiment, when read in light of the accompanying drawings.

DETAILED DESCRIPTION OF THE INVENTION

Simulated corner stone products can be in the form of corner pieces, corner hearth pieces and corner architectural trim pieces as well as other corner-shaped products. Simulated corner stone products are manufactured using a mold filled with castable material flowing from a hopper.

The castable material can be any material, such as concrete or plaster of paris, suitable for being molded into simulated corner stone products.

Figure 1:
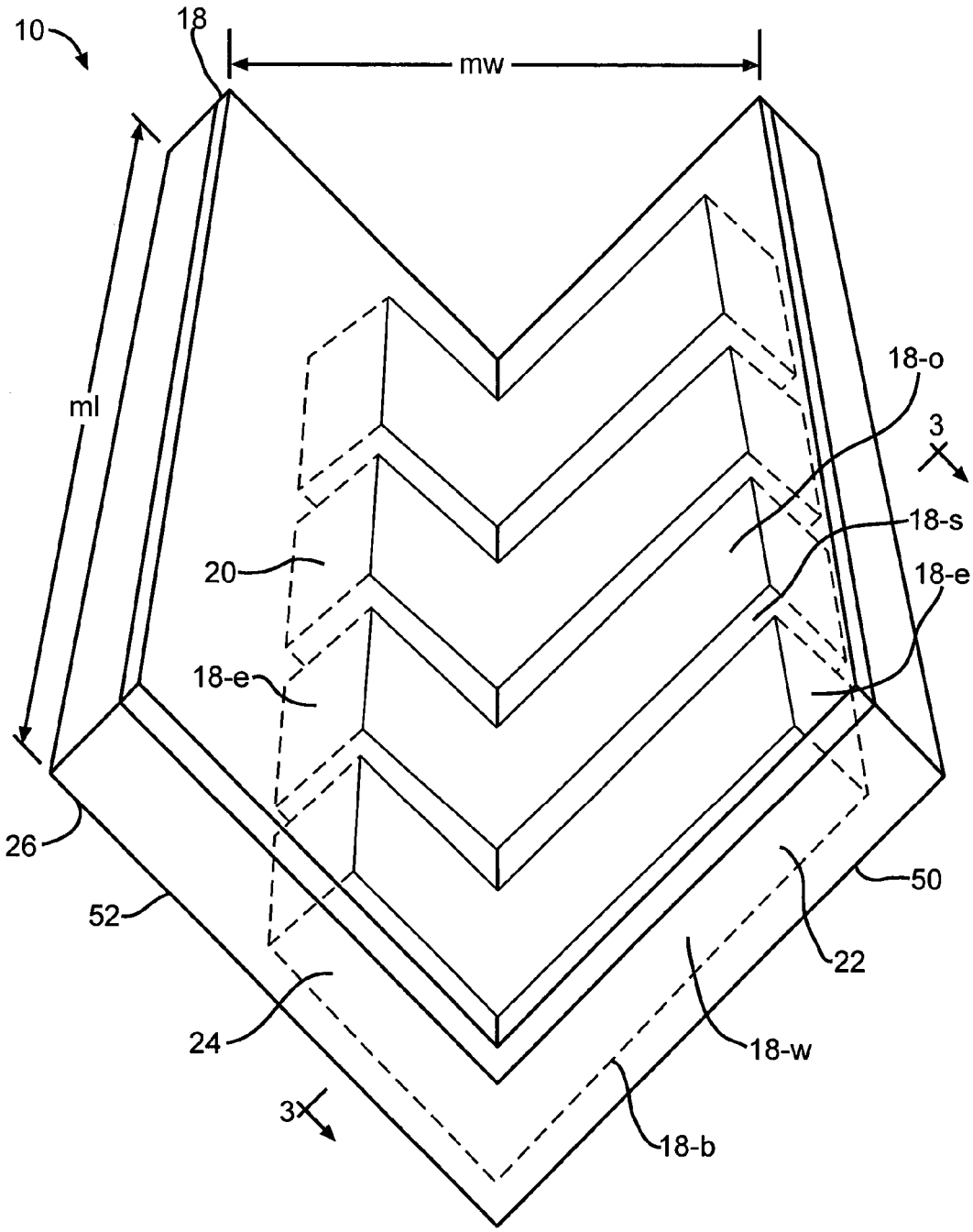
FIG. 1 is a perspective view, partially in phantom, of a mold for a simulated stone product.
Figure 3:
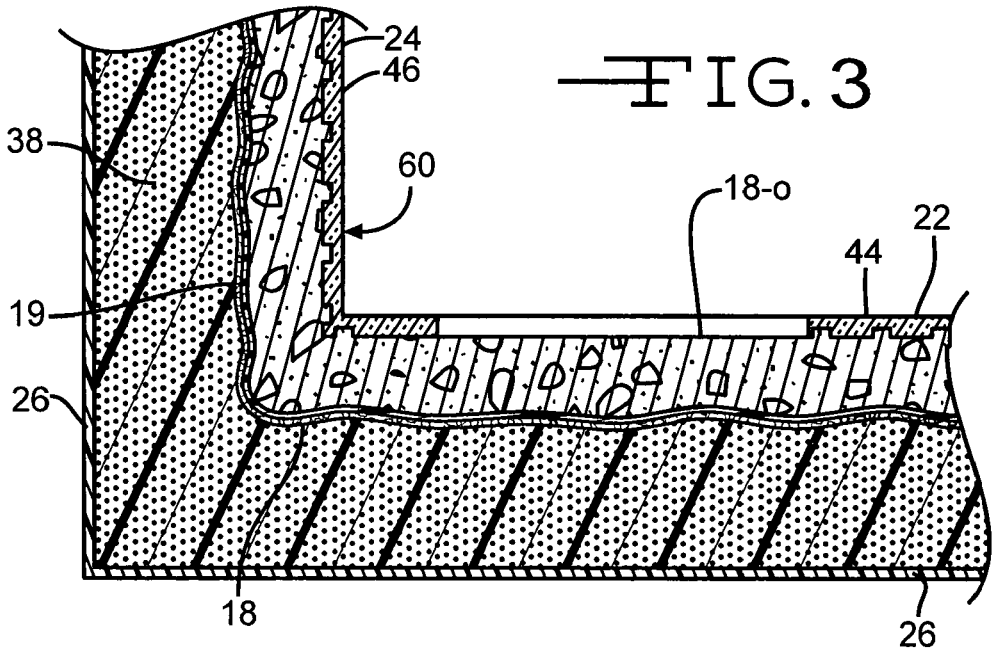
FIG. 3 is a side elevational view of the mold of FIG. 1 taken along line 3-3 of FIG. 1.

In one embodiment as shown in FIG. 1, a mold 10 includes at least one flexible layer 18 having one or more mold cavities 20. As shown in FIG. 3, the mold cavities are configured to receive a castable material 46 and shape the castable material 46 into simulated stone products. Referring again to FIG. 1, in this embodiment, the mold 10 is illustrated with four mold cavities 20. Alternatively, the mold 10 can have any number of mold cavities 20.

As shown in FIG. 1, the mold 10 has a mold length ml and a mold width mw. The mold length ml and the mold width mw are configured to accommodate the desired number of mold cavities 20. It will be appreciated that the mold length ml and the mold width mw will change depending on the quantity and size of mold cavities 20 located within the mold 10.

The flexible layer 18 is configured to include the mold cavities 20 and to flex when the simulated stone products are removed from the mold cavities 20. The flexible layer 18 can be made from one or more layers of a suitable flexible material, such as a curable elastomeric, latex or silicone rubber, or any other material suitable to include the mold cavities 20 and to flex when the simulated stone products are removed from the mold cavities 20. Alternatively, the cavities may be made from a less elastomeric or non-elastomeric material, however the products and textures made using such materials may be limited.

Figure 2:
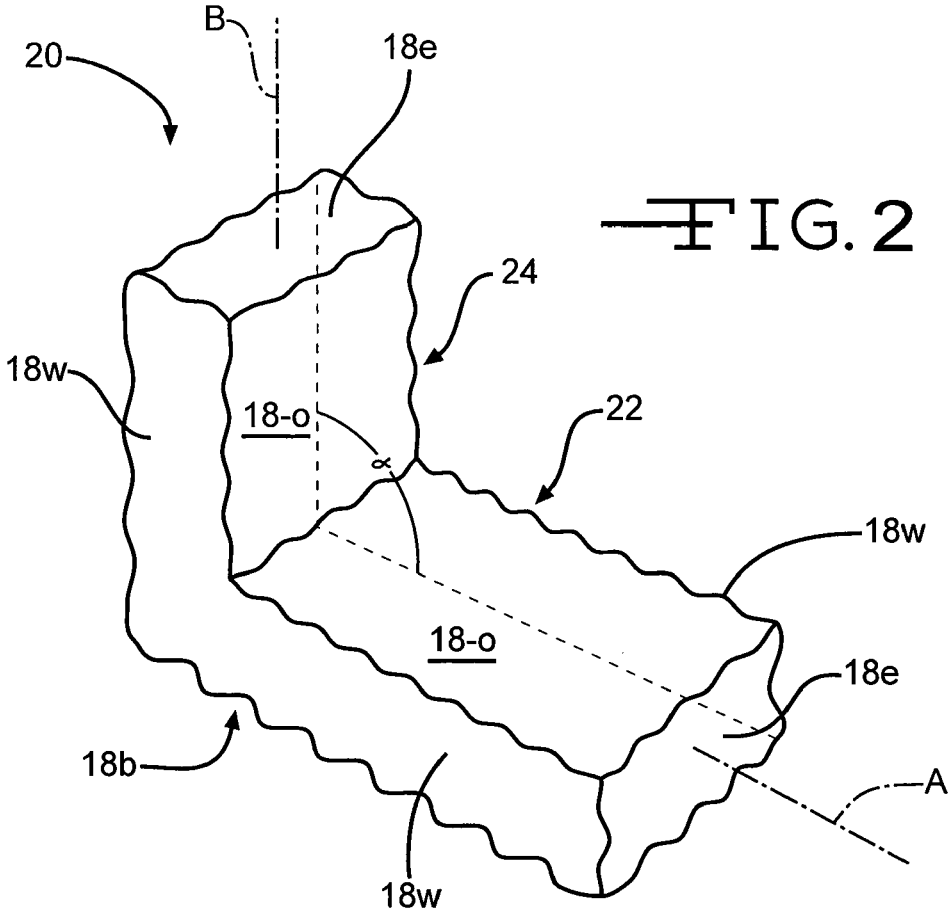
FIG. 2 is a schematic perspective view, partially in phantom, of a mold cavity of the mold shown in FIG. 1.

As shown in FIG. 2, the mold cavities 20 have a corner shape. The mold cavities 20 have a first section 22 having a first longitudinal axis A that is in communication with a second section 24 having a second longitudinal axis B. The intersection of the first longitudinal axis A of the first section 22 and the second longitudinal axis B of the second section 24 form a cavity angle $\alpha$. The cavity angle $\alpha$ is configured to provide a desired surface and angle for attachment of the simulated stone product to a support structure. In this embodiment, the cavity angle $\alpha$ is a 90° angle. Alternatively, the cavity angle $\alpha$ can be any angle, more or less than 90° sufficient to provide a desired surface and angle for attachment of the simulated stone product to a support structure. While the corners are shown as being square, in an alternative embodiment, the corners may be any shape, such as a curvilinear interior and/or exterior surface to form e.g. stone for forming around a round column.

As shown in FIG. 2, the first and second sections 22 and 24 of the mold cavity 20 have different lengths. The different lengths of the first and second sections 22 and 24 of the mold cavity 20 are configured to provide a desired aesthetic appearance of the simulated stone product. In this embodiment, the first section 22 can be about two to four times longer than the second section 24. In another embodiment, the first and second sections 22 and 24 of the mold cavity 20 can have substantially the same length.

The first and second mold cavity sections 22 and 24 have an end wall 18-*e* and opposing sidewalls 18-*w* . The opposing sidewalls 18-*w* and the end walls 18-*e* form the outer perimeters of the first and second sections 22 and 24. The mold cavity sections 22 and 24 have a bottom 18-*b* and an opposing, top openings 18-*o*. The mold cavity sidewalls 18-*w*, the end walls 18-*e* and the bottom 18-*b* have a stone textured surface.

In certain embodiments as shown in FIG. 1, the flexible layer 18 also has support sections 18-*s* . The support sections 18-*s* are defined by the areas surrounding the mold cavity sidewalls 18-*w* and the mold cavities 20. The support sections 18-*s* divide the mold 10 into the individual mold cavities 20. In certain embodiments, the support sections 18-*s* have a flexible modulus that is stiffer or more rigid than the flexural modulus of the mold cavity bottom 18-*b*, the end walls 18-*e*, and the mold cavity sidewalls 18-*w* . An embodiment using a more rigid section utilizes the principles of copending application Ser. No. 11/295,118, which is incorporated herein by reference in its entirety.

In certain embodiments, the flexible layer 18 can include a reinforcing material (not shown). The reinforcing material is added to, or encapsulated within, the sidewalls 18-*w* . The reinforcing material reinforces the sidewalls 18-*w*, yet allows the sidewalls 18-*w* to still retain the desired flexibility. In certain embodiments, the reinforcing material can comprise a paste-like material, comprising, for example, a latex material, ground up rubber tires, sawdust, and MgO composition.

In certain embodiments as shown in FIGS. 1 and 3, the mold 10 includes a mold support 26. The mold support 26 is configured to hold the flexible layer 18. Optionally, the mold support 26 can include a backing layer 19. The backing layer 19 is configured to support the flexible layer 18. In this embodiment, the backing layer 19 comprises a porous material such as, for example, a breathable mesh material. In another embodiment, the backing layer 19 can be a polyurethane-fiberglass applied non-woven mat material or any other material sufficient to support the flexible layer 18.

In this embodiment as shown in FIG. 3, a material 38 is positioned between the mold support 26 and the backing layer 19. The material 38 is configured to be a load supporting material capable of providing structural support to the flexible layer 18. The material 38 can be any type of structural material such as, for example, foams such as polyurethane, polystyrene and polyphenylene oxide, or any other type of material sufficient to be a load supporting material capable of providing structural support to the flexible layer 18.

In certain embodiments as shown in FIG. 3, the mold cavities 20 are painted with a layer 44 of one or more suitable stone-colored paints. In certain embodiments, especially where the flexible layer 18 has deep and/or narrow sidewalls 18-*w* and end walls 18-*e*, the painting of such vertical surfaces can be done by inflating the flexible layer 18 to open up the mold cavity 20 and allow easier painting of the end walls 18-*e*, the sidewalls 18-*w* and the bottom 18-*b* . Alternatively, the surfaces may be painted or stained after the surfaces are removed from the mold.

In this embodiment as shown in FIG. 1, the mold 10 includes a first mold side 50 and a second mold side 52. The first section 22 of the mold cavity 20 is disposed within the first mold side 50. Similarly, the second section 24 of the mold cavity 20 is disposed within the second mold side 52. In another embodiment, the first section 22 of the mold cavity 20 could be disposed within the second mold side 52 and the second section 24 of the mold cavity 20 could be disposed within the first mold side 50.

Figure 4:
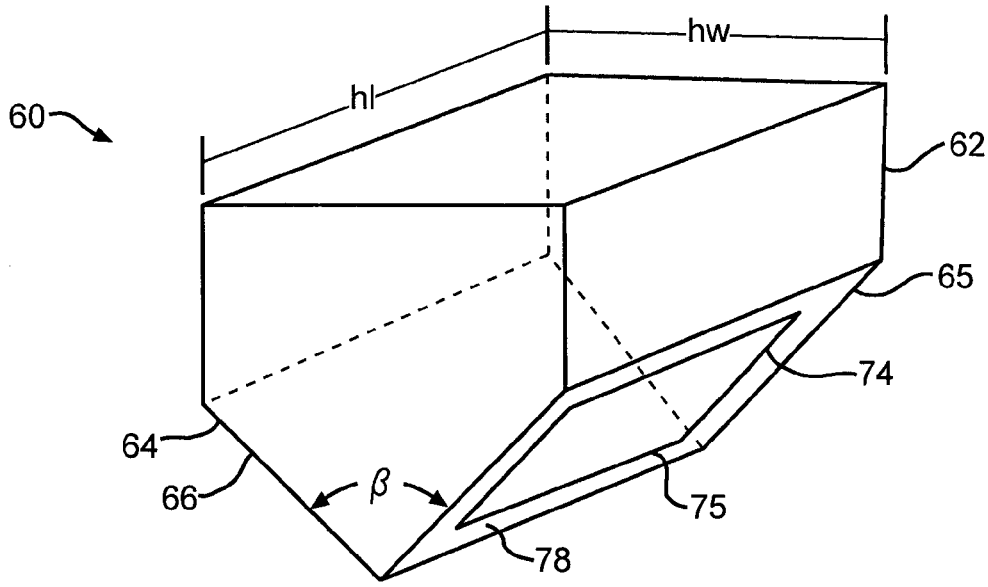
FIG. 4 is a schematic perspective view, partially in phantom, of a hopper for a simulated stone product.
Figure 5:
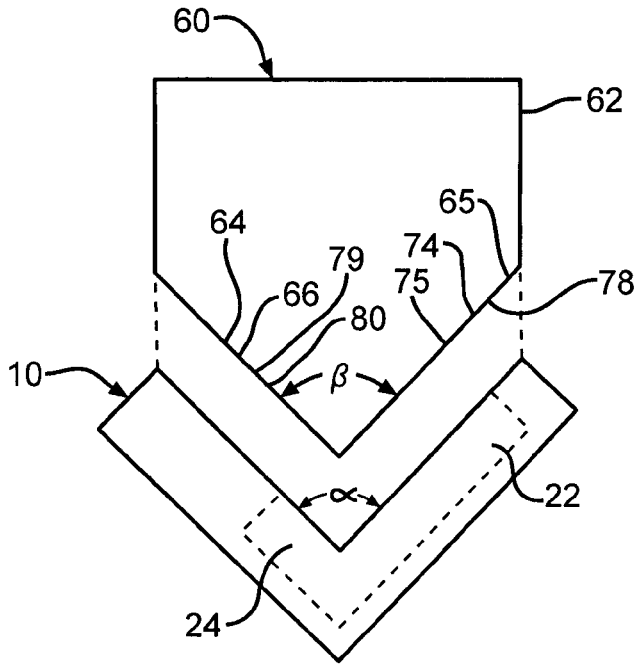
FIG. 5 is a front elevational view, partially in phantom, of the hopper of FIG. 4 in cooperation with the mold of FIG. 1.

As shown in FIGS. 4 and 5, a hopper 60 is configured to supply castable material (not shown) to the mold 10. The hopper 60 can be made of any material, such as metal or reinforced plastic, sufficient to contain the castable material and supply the castable material to the mold 10. The hopper 60 has a hopper length hl and a hopper width hw. In this embodiment, the hopper length hi is the same length as the mold length ml. Similarly, in this embodiment the hopper width hw is the same width as the mold width mw. In another embodiment, the hopper length hi can be a different length than the mold length ml and the hopper width hw can be a different length than the mold width mw.

As further shown in FIGS. 4 and 5, the hopper 60 includes a vessel 62. The vessel 62 is configured guide the castable material (not shown) to a hopper opening 75. In this embodiment, the vessel 62 has a box-like volumetric shape. In another embodiment, the vessel 62 can have any other volumetric shape, such as a cylindrical shape, sufficient to guide the castable material to the hopper opening 75.

Again referring to FIGS. 4 and 5, the hopper 60 also contains a funnel area 64. The funnel area 64 is disposed at the base of the vessel 62. The funnel area 64 is configured to direct the flow of castable material toward the hopper opening 75. In this embodiment, the funnel area 64 has a triangular cross-sectional shape. In another embodiment, the funnel area 64 can have another cross-sectional shape sufficient to direct the flow of the toward the hopper opening 75.

The funnel area 64 includes opposing funnel walls 65 and 66. The opposing funnel walls 65 and 66 intersect to form a funnel angle β. Funnel angle β is configured to substantially correspond with the cavity angle α of the mold cavity. In this embodiment, funnel angle β is a 90° angle. Alternatively, the funnel angle β can be any angle that corresponds with the cavity angle α.

As shown in FIG. 4, the funnel wall 65 includes the hopper opening 75. The hopper opening 75 is configured to correspond to the top openings 18-*o* of the first sections 22 of the mold cavities 20. In this embodiment, the hopper opening 75 has a rectangular shape. In another embodiment, the hopper opening 75 can have another shape, such as a square shape, sufficient to correspond to the top opening 18-*o* of the first section 22 of the mold cavities. In this embodiment, the funnel wall 66 is a solid wall. The funnel wall 66 is configured to direct castable material in the hopper toward the hopper opening 75. In another embodiment, the hopper opening 75 can be disposed on the funnel wall 66 and the funnel wall 65 can be a solid wall.

As further shown in FIGS. 4 and 5, funnel wall 65 includes a seal member 78. The seal member 78 defines the perimeter of the hopper opening 75. The seal member 78 is configured to contact the first mold side 50 and cooperate with the first mold side 50 such that the castable material only flows into the first section 22 of the mold cavity 20. The seal member 78 can be any material, such as wood, rubber, or plastic, or any other material sufficient to contact the mold 10 and prevent spilling of the castable material outside the mold 10 as the castable material is being fed into the first section 22 of the mold cavity 20. However, the use of the seal member 78 is optional.

In operation, first and second sections 22 and 24 of the mold 10 can be painted. However, painting of the first and second sections 22 and 24 is optional and not necessary to the operation of the apparatus for manufacturing simulated stone product.

As shown in FIG. 5, the mold 10 is indexed underneath the hopper 60 such that the funnel angle β aligns with the cavity angle α and the first seal member 78 aligns with the first sections 22 of the mold cavities 20.

Figure 6:
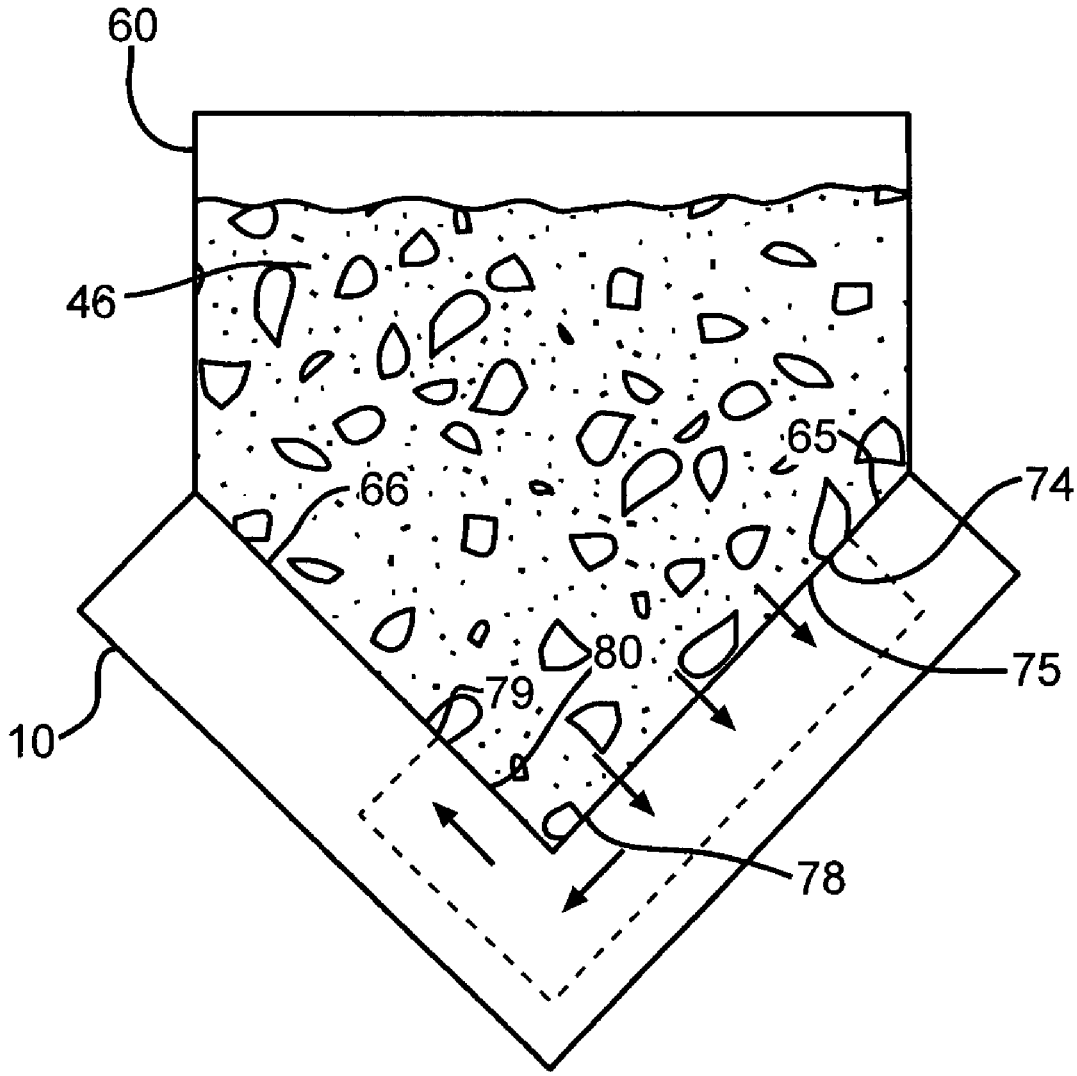
FIG. 6 is a front elevational view, partially in phantom, of the hopper of FIG. 4 sealed against the mold of FIG. 1.

As shown in FIG. 6, the mold 10 is raised such that the seal member 78 of the hopper 60 contacts the first mold side 50. The mold 10 can be raised by any suitable mechanism, such as by a hydraulic mechanism. The seal member 78, in contact with the first mold side 50, is configured to substantially contain or direct the flow of the castable material 46 from the hopper 60 to the mold cavities 20.

In the raised position, the second mold side 52 of the mold 10 contacts the funnel wall 66. The contact of the second mold side 52 with the funnel wall 66 forms a containment member 79. The containment member 79 is configured to form a barrier 80. The barrier 80 is configured to substantially close off the top opening 18-*o* of the second section 24 of the mold cavity 20. Although the mold 10 is shown as moving upward to the hopper 60, it is to be understood that the hopper 60 can be lowered to the mold 10.

As shown in FIG. 6, a desired quantity of castable material 46 is deposited into the hopper 60. In this embodiment, the castable material 46 is supplied to the hopper 60 from a storage hopper (not shown). In another embodiment, the castable material 46 is supplied to the hopper 60 by another manner, such as by a conveyor, sufficient to supply a desired quantity of castable material 46 into the hopper 60. In this embodiment, an amount of castable material 46 is deposited into the hopper 60 sufficient to fill the mold cavities 20. In another embodiment, the quantity of castable material 46 supplied to the hopper 60 can be any amount, including more or less than the amount sufficient to fill the mold cavities 20.

In an alternative embodiment, the hopper 60 is replaced with one or more feeders, the feeders being preferably tubular extrusion devices A mold vibrator (not shown), connected to the mold 10, is activated. The mold vibrator is configured to vibrate the mold 10 as the castable material 46 flows from the hopper 60 into the first section 22 of the mold cavity 20. The mold vibrator is well known in the art and can be any mechanism or assembly that vibrates the mold 10 sufficient to allow the castable material 46 to flow into the first section 22 of the mold cavity 20. It can be seen that, with the help of the vibrator, the castable material 46 can flow by gravity, into and completely fill the mold cavity 20, including both mold cavity 22 and mold cavity 24.

The castable material 46 in the hopper 60, guided by the vessel 62 and the funnel walls 65 and 66, flows to the hopper opening 75. The castable material 46 flows through the hopper opening 75 into the top opening 18-*o* of the first section 22 of the mold cavity as shown in FIG. 6.

As the flow of castable material 46 enters the first section 22 of the mold cavity 20, the mold vibrator vibrates the mold 10 to urge the flow of the castable material 46 from the first section 22 of the mold cavity 20 to the second section 24 of the mold cavity 20. As the castable material 46 flows from the first section 22 to the second section 24, the castable material flows underneath the closed off top opening 18-*o* of the second section 24, formed by the barrier 80, of the mold cavity 20. The barrier 80 contains the castable material 46 within the second section 24 of the mold cavity 20.

The seal member 78 sealing the first section 22 of the mold cavity 20 to the hopper 60 prevents excess castable material 46 from spilling onto other portions of the mold 10. By prevent excess spillage, a reduced volume of the castable material 46 is necessary to manufacture the simulated stone products. By reducing the volume of castable material 46 required to manufacture the simulated stone products, the simulated stone products can be manufactured less costly and more efficiently. In this embodiment, the reduction in the volume of castable material 46 is in a range from about 40% to about 60%. In another embodiment, the reduction in the volume of castable material 46 can be more than 60% or less than 40%. The reduced volume of castable material 46 also results in less screeding, since the amount of overpour of the castable material 46 is limited to a smaller section of the mold 10. Less screeding results in less labor and more cost effective simulated stone products.

Figure 7:
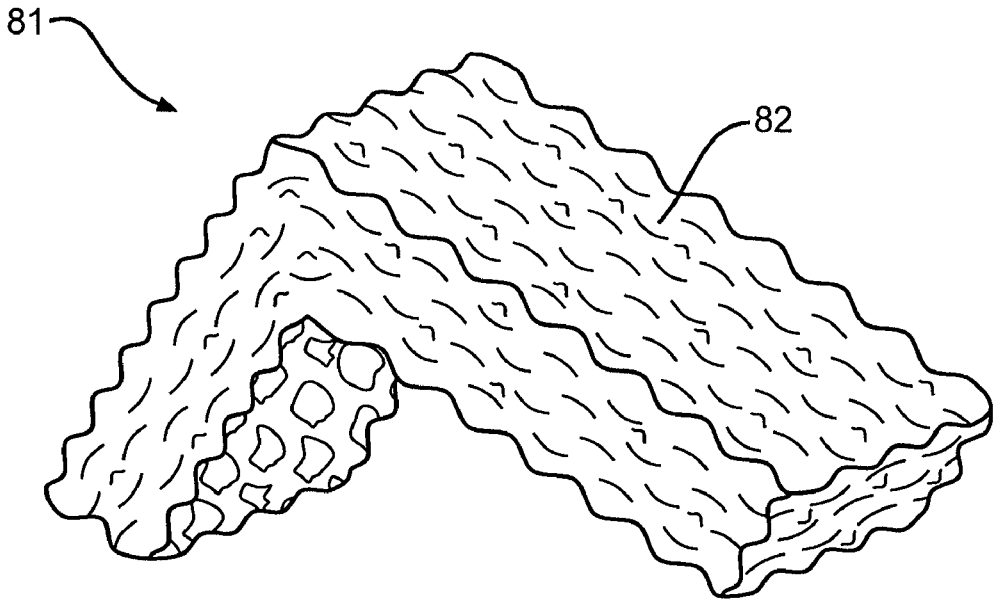
FIG. 7 is a schematic perspective view of a simulated stone product, as viewed from its front face.
Figure 8:
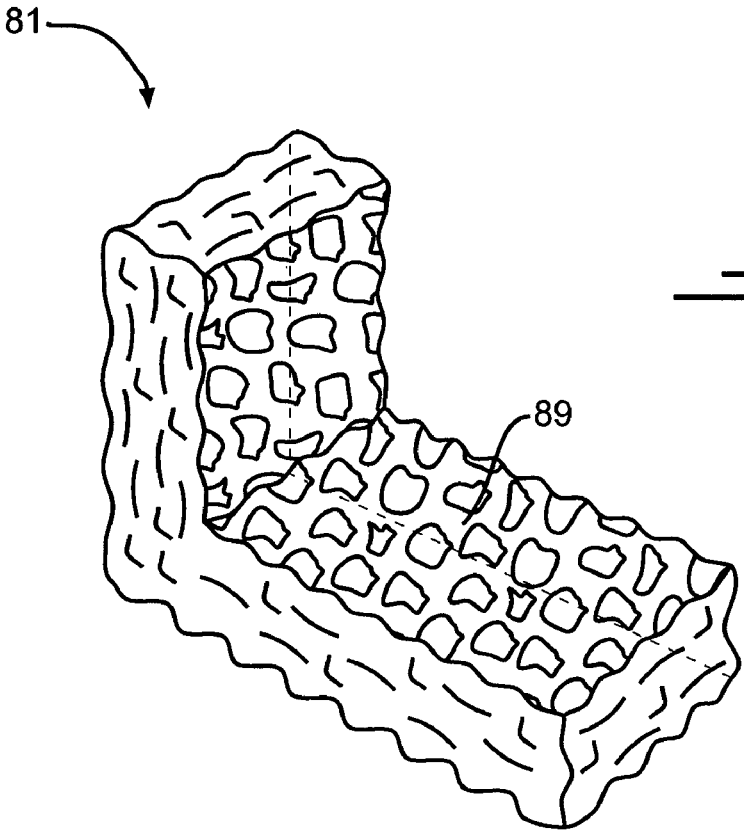
FIG. 8 is a schematic perspective view, of a simulated stone product, as viewed from its back face.

Upon hardening, the castable material 46 in the mold cavities 20 becomes a simulated stone product 81, which is schematically illustrated in FIGS. 7 and 8. After hardening, the simulated stone product 81 is removed from the mold cavity 20 in a suitable manner, including introducing a pressurized fluid, such as air, between the flexible layer 18 and the mold support 26. Alternatively, any other method of removing the simulated stone product 81 from the mold 20 can be used. As shown in FIG. 7, the simulated stone product 81 can have a textured simulated stone front face 82. In this embodiment as shown in FIG. 8, the simulated stone product 81 has a non-textured back face 89. Alternatively, the back face 89 can have any other texture, such as a texture conducive for application to a structural surface.

Figure 9:
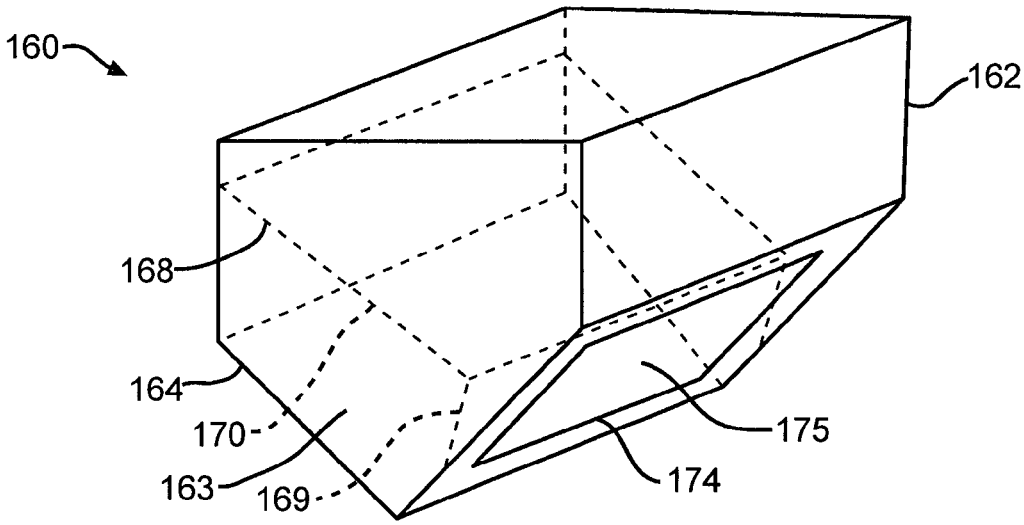
FIG. 9 is a schematic perspective view, partially in phantom, of a second embodiment of a hopper for a simulated stone product.
Figure 10:
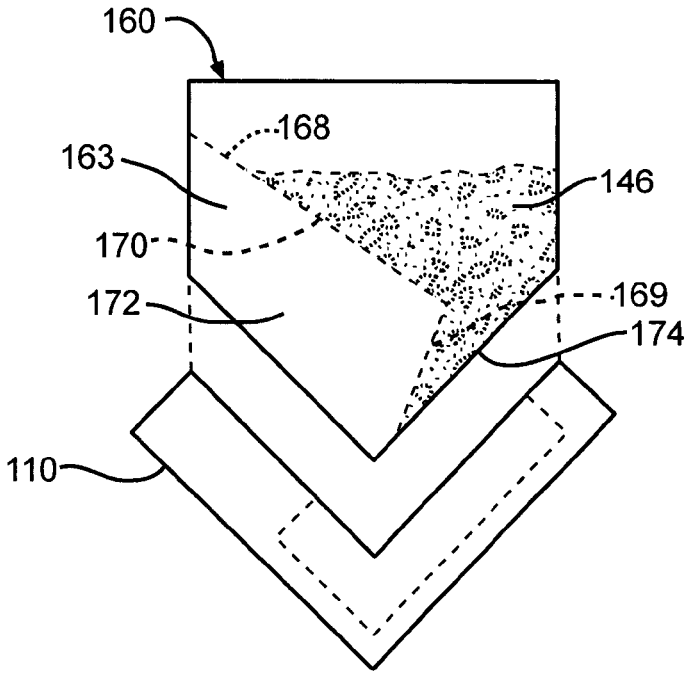
FIG. 10 is a front elevational view, partially in phantom, of the hopper of FIG. 9 in cooperation with the mold of FIG. 1.

In another embodiment as shown in FIGS. 9 and 10, the hopper 160 includes a hopper partition 168. The hopper partition extends within the vessel 162 and the funnel area 164 to create a void area 163. The hopper partition 168 is configured to prevent castable material 146 from filling the void area 163, thus reducing the volume of castable material 146 contained within the hopper 160, as shown in FIG. 10. By reducing the volume of castable material 146 used in the manufacturing process, the simulated stone products can be manufactured less expensively. In this embodiment, the reduction in the volume of excess castable material 146 is in a range from about 40% to about 60%. In another embodiment, the reduction in the volume of castable material 146 can be more than 60% or less than 40%.

In this embodiment, the hopper partition 168 includes a first partition wall 169 and a second partition wall 170. The first and second hopper walls, 169 and 170, cooperate to prevent castable material 146 from filling the void area 163 defined by the partition 168. Additionally, the first and second hopper walls, 169 and 170, are configured to guide the castable material 146 to the hopper opening 175. The first and second hopper walls, 169 and 170, can be made of any material, including metal and reinforced plastic, sufficient to prevent castable material 146 from filling the void area 163 and guide the castable material 146 to the hopper opening 175.

Figure 11:
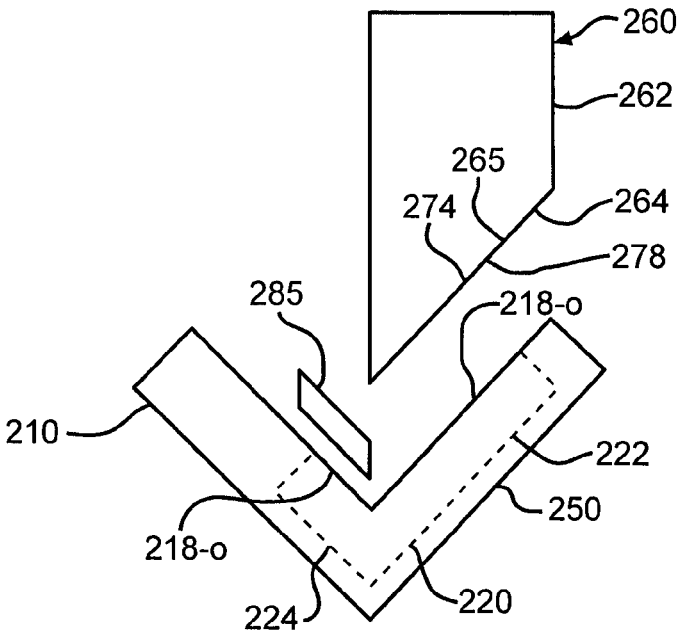
FIG. 11 is a schematic perspective view, partially in phantom, of a third embodiment of a hopper for a simulated stone product.

In another embodiment as shown in FIG. 11, a hopper 260 is configured to supply castable material (not shown) to the mold 210. The hopper 260 includes a vessel 262 and a funnel area 264. The funnel area 264 includes a funnel wall 265 having a hopper opening 275. The hopper opening 275 is configured to correspond to the top openings 218-*o* of the first sections 222 of the mold cavities 220.

As further shown in FIG. 11, funnel wall 265 includes a seal member 278. The seal member 278 defines the perimeter of the hopper opening 275. The seal member 278 is configured to contact the first mold side 250 and cooperate with the first mold side 250 such that the castable material only flows into the first section 222 of the mold cavity 220.

A first cover member 285 is connected to the second section 224 of the mold 210. The first cover member 285 is configured to substantially cover the top opening 218-*o* of the second section 224 of the mold 210.

In operation, castable material flows through the hopper 260 to the hopper opening 275. The castable material flows through the hopper opening 275 into the top opening 218-*o* of the first section 222. As the flow of castable material enters the first section 222 of the mold cavity 220, a mold vibrator (not shown) vibrates the mold 210 to urge the flow of the castable material from the first section 222 of the mold cavity 220 to the second section 224 of the mold cavity 220. As the castable material flows from the first section 222 to the second section 224, the castable material flows underneath the first cover member 285. The first cover member 285 contains the castable material within the second section 224 of the mold cavity 220.

Figure 12:
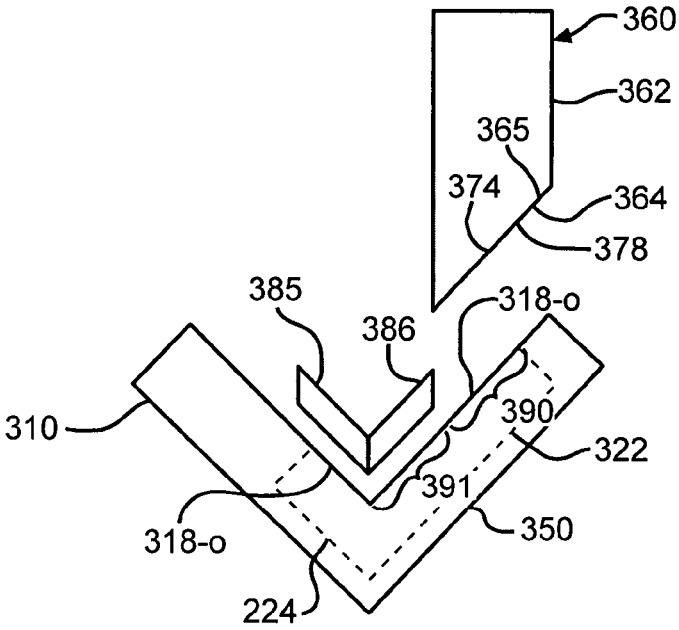
FIG. 12 is a schematic perspective view, partially in phantom, of a fourth embodiment of a hopper for a simulated stone product.

In another embodiment as shown in FIG. 12, a hopper 360 is configured to supply castable material (not shown) to the mold 310. The hopper 360 includes a vessel 362 and a tapered funnel area 364. The tapered funnel area 364 includes a funnel wall 365 having a hopper opening 375. The hopper opening 375 is configured to correspond to a first portion 390 of the top openings 318-*o* of the first sections 322 of the mold cavities 320.

As further shown in FIG. 12, the funnel wall 365 includes a seal member 378. The seal member 378 defines the perimeter of the hopper opening 375. The seal member 378 is configured to contact the first mold side 350 and cooperate with the first mold side 350 such that the castable material only flows into the top opening 318-*o* of the first section 322 of the mold cavity 320.

A first partial cover 385 is connected to the second section 324 of the mold 310. The first partial cover 385 is configured to substantially close off the top opening 318-*o* of the second section 324 of the mold 310. A second partial cover 386 is connected to the first section 322 of the mold 310. The second partial cover 386 is configured to substantially cover a second portion 391 of the top opening 318-*o* of the first section 322 of the mold 310.

In operation, castable material flows through the hopper 360 to the hopper opening 375. The castable material flows through the hopper opening 375 into the top opening 318-*o* of the first section 322. As the flow of castable material enters the first section 322 of the mold cavity 320, a mold vibrator (not shown) vibrates the mold 310 to urge the flow of the castable material from the first section 322 of the mold cavity 320 to the second section 324 of the mold cavity 320. As the castable material flows from the first section 322 to the second section 324, the castable material flows underneath the second partial cover 386 closing off the second portion 391 of the top opening 318-*o* of the first section 322. The castable material also flows underneath the first partial cover 385 closing off the first portion 390 of the top opening 318-*o* of the second section 324. The first and second partial covers 385 and 386 contain the castable material within the second section 324 of the mold cavity 320 and the second portion 391 of the first section 322 of the mold cavity 320.

Figure 13:
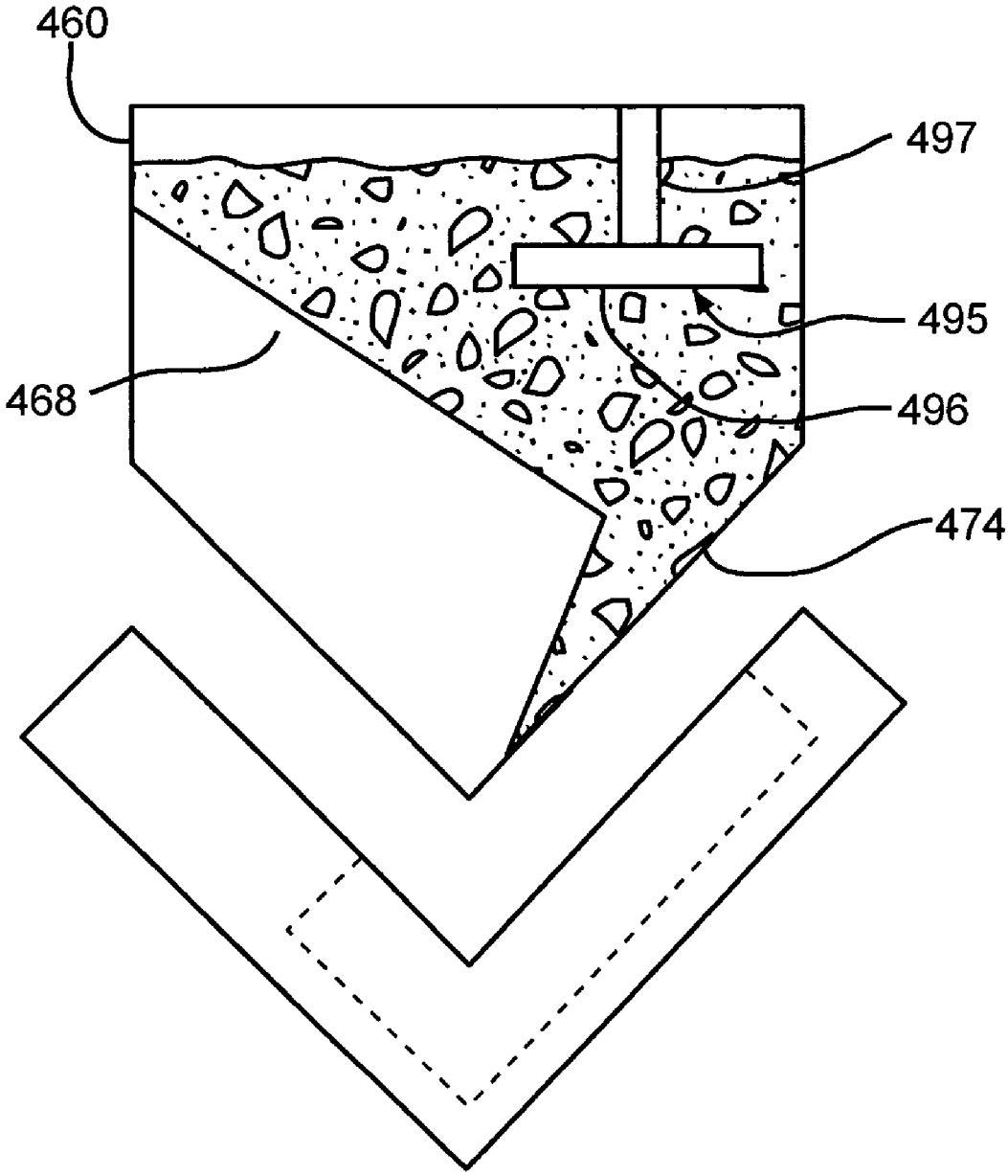
FIG. 13 is a front elevational view, partially in phantom, of the hopper of FIG. 9 having a plunger.

In another embodiment as shown in FIG. 13, the hopper 460 includes a hopper partition 468. The hopper partition 468 is configured to reduce the volume of the castable material flowing through the hopper 460 as shown in FIG. 13, thereby simulated stone products can be manufactured less expensively.

A hopper plunger 495 is disposed within the hopper 460. The hopper plunger 495 includes a ram 496. The plunger 495 is configured to push the ram 496 into contact the castable material (not shown) and push the castable material through the hopper opening 475. In this embodiment, the ram 496 is a solid plate, but the ram 496 can be a frame, a mesh framework, a framework including structural projections or any other device suitable for contacting and driving the castable material through the hopper opening 475. The ram 496 can be made of any material, including wood, plastic, metal or any other material suitable for contacting and driving the castable material toward the hopper opening 475.

In this embodiment, the ram 496 is driven by a ram actuator (not shown) connected to the ram 496 by a ram connecting rod 497. The ram actuator can be any mechanism or assembly, such as for example a hydraulic system or a pneumatic system, sufficient to drive the ram 496 to push the castable material.

The principle and mode of operation of this blowing wool machine have been described in its preferred embodiments. However, it should be noted that the blowing wool machine may be practiced otherwise than as specifically illustrated and described without departing from its scope.

What is claimed is:

1. An apparatus for manufacturing simulated stone products, the apparatus comprising:

a mold having one or more mold cavities, the mold cavities having a first section and a second section, the first and second sections having a longitudinal axis, the longitudinal axis of the first section intersecting with the longitudinal axis of the second section to form a cavity angle, the first and second sections having top openings, the first and second sections being positioned such that castable material introduced into the top opening of the first section can flow by gravity into the second section; and a hopper configured to introduce castable material into the top opening of the first section of the mold cavity, the hopper and the mold being moveable with respect to each other, enabling them to be selectively engaged with each other, the hopper including a first funnel wall and a second funnel wall, the angle between the first funnel wall and the second funnel wall being the same as the cavity angle, the first funnel wall being configured to contact the top of the of the first mold cavity and to introduce castable material into the top opening of the first section of the mold cavity, the second funnel wall being configured to contact the top of the second mold cavity and act as a barrier to close the top opening of the second section of the mold cavity, the hopper and the mold being separable to allow removal of the simulated stone product from the mold cavity after hardening.

2. The apparatus of claim 1 in which the mold is positioned underneath the hopper, the mold and the hopper being configured to contact each other.

3. The apparatus of claim 2 in which the hopper includes a hopper opening configured to allow the introduction of the castable material into the top opening of the first section of the mold cavities, the hopper opening having a seal member structured to seal the hopper to the mold, wherein the seal member contains the castable material within the top opening of the first section of the mold cavity as the castable material is introduced into the top opening of the first section of the mold cavity.

4. The apparatus of claim 1 in which the hopper includes a partition and a hopper opening, the hopper opening being configured to allow the introduction of the castable material into the top opening of the first section of the mold cavities, the partition being configured to guide the castable material to the hopper opening.

5. The apparatus of claim 1, in which the hopper includes a plunger, the plunger configured to contact the castable material and push the castable material through the hopper opening.

6. The apparatus of claim 1 in which the cavity angle is more than 90° or less than 90°.

7. The apparatus of claim 1 in which the mold includes a vibrating mechanism configured to vibrate the mold as the castable material flows from the first section to the second section.

8. The apparatus of claim 1 in which at least one partial cover is removably connected to the first section of the mold cavities, the at least one partial cover being configured cover a portion of the top opening of the first section of the mold cavity white leaving open the remainder of the top opening for the introduction of the castable material as the castable material flows into the first section, the at least one partial cover being removable to allow the simulated stone product to be removed from the mold cavity after hardening.

* * * * *